US006975274B2

(12) United States Patent
Sanchez et al.

(10) Patent No.: US 6,975,274 B2
(45) Date of Patent: Dec. 13, 2005

(54) AUTOMATIC ANTENNA ORIENTATION FOR USB PASS-THROUGH PORT

(75) Inventors: Russell Irvin Sanchez, Medina, WA (US); Ferdinand Johannes van Engelen, Bellevue, WA (US); Robert J. Furlow, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 54 days.

(21) Appl. No.: 10/607,828

(22) Filed: Jun. 27, 2003

(65) Prior Publication Data

US 2004/0263417 A1 Dec. 30, 2004

(51) Int. Cl.[7] ..... H01Q 1/24

(52) U.S. Cl. ..... 343/702

(58) Field of Search ..... 343/702, 906, 343/700 MS, 900, 880

(56) References Cited

U.S. PATENT DOCUMENTS

| | | | | |
|---|---|---|---|---|
| 6,531,985 | B1 * | 3/2003 | Jones et al. | 343/702 |
| 6,758,689 | B1 * | 7/2004 | Bair et al. | 439/136 |
| 6,791,500 | B2 * | 9/2004 | Qi et al. | 343/702 |
| 2004/0075613 | A1 * | 4/2004 | Jarmuszewski et al. | 343/702 |

OTHER PUBLICATIONS

Adam Zev Steinberg, "A-List: Peripherals and Gadgets—Best Products and Services for Every Business", Ziff Davis Smart Business for the New Economy, PP. 214, May 1, 2000 (2 pgs.).

3Com Corp., "Net.Worker Briefs", Network World, PP. 21, Jan. 11, 2001 (1 pg.).

Ideative, Inc., "Ideative's FlexUSB™ to Reveal a New 'Twist' at CES", 2002 (2 pgs.).

* cited by examiner

*Primary Examiner*—Don Wong
*Assistant Examiner*—Huedung X. Cao
(74) *Attorney, Agent, or Firm*—Merchant & Gould; Brett A. Hertzberg

(57) ABSTRACT

An apparatus, system, and method are generally related to an antenna device that includes a pass-through interface such as for a USB device. The antenna device is enclosed in a housing. The pass-through interface includes two ports. The housing is coupled to the pass-through interface body such that one of the ports is blocked by a blocking member when the housing is in a first position. The blocking member prevents impact damage to the blocked port, while also preventing dirt and dust from collecting. The blocking member is cleared from the opening of the blocked port when the housing is biased into a second position by inserting a connector. The blocking member automatically returns to the first position when the connector is removed from the port. Antenna performance is improved by automatically aligning the antenna away from the connector, which may otherwise degrade performance.

26 Claims, 12 Drawing Sheets

AUTOMATIC ANTENNA ORIENTATION FOR USB PASS-THROUGH PORT

FIELD OF THE INVENTION

The present invention relates generally to an apparatus for orienting an antenna. More particularly, the present invention relates to an apparatus that couples an antenna device to a USB port, where the antenna is automatically aligned away from a pass-through connection to the USB port when a USB cable is inserted into the pass-through port. Antenna performance is improved by reducing possible signal interference from the USB cable.

BACKGROUND OF THE INVENTION

Personal computer technologies have been embraced in many portable electronics devices including: cellular telephones, personal data assistants (PDAs), laptop computers, MP3 players, pen-drives, digital video cameras, as well as other mobile devices. Many of the portable electronic devices can be configured to operate with various peripheral devices such as a computer mouse, a computer writing tablet, a digital camera, as well as others. Moreover, many of the portable electronic devices are also configured to interface with personal computers through a standard interface.

The need for standardization in computer related interfaces, as well as the need for high-speed communication interfaces has lead to the development of the universal serial bus (USB). The USB interface is a high-speed communication protocol that permits devices to communicate at data rates on the order of 48 Mb/s. A revised USB interface such as the USB 2.0 specification can operate at even higher speeds that are on the order of 480 Mb/s. The high speed USB interface has lead to widespread acceptance of external peripheral devices such as USB HDD systems, USB Ethernet devices, USB compact disk writing devices (e.g., CD/RW), as well as other devices.

SUMMARY OF THE INVENTION

Briefly stated, an apparatus, system, and method are generally related to an antenna device that includes a pass-through interface such as for a USB device. The antenna device is enclosed in a housing. The pass-through interface includes two ports. The housing is coupled to the pass-through interface body such that one of the ports is blocked by a blocking member when the housing is in a first position. The blocking-member prevents impact damage to the blocked port, while also preventing dirt and dust from collecting. The blocking-member is cleared from the opening of the blocked port when the housing is biased into a second position by inserting a connector. The blocking-member automatically returns to the first position when the connector is removed from the port. Antenna performance is improved by automatically aligning the antenna away from the connector, which may otherwise degrade performance.

A more complete appreciation of the present invention and its improvements can be obtained by reference to the accompanying drawings, which are briefly summarized below, to the following detailed description of illustrative embodiments of the invention, and to the appended claims.

DETAILED DESCRIPTION OF THE PREFERRED EMBODIMENT

Figure 1A:
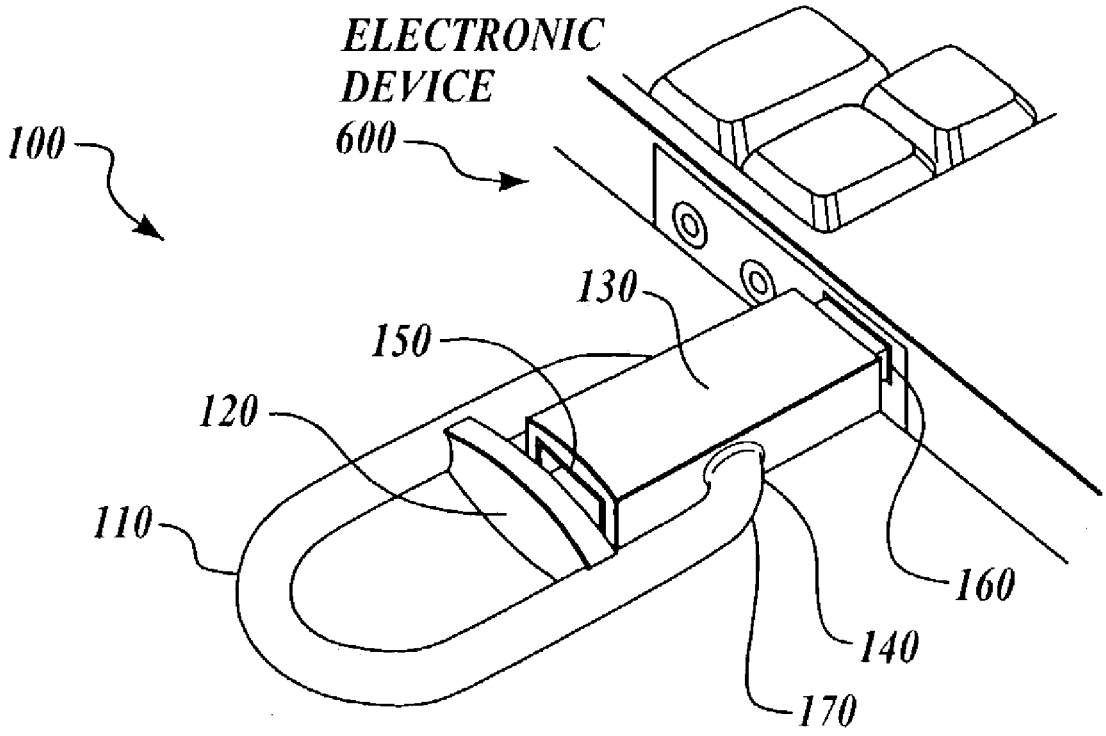
FIGS. 1A–1C are diagrams illustrating example antenna devices that include a pass-through port that is coupled to an electronic device.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

The present invention is described in the context of an antenna device that may be coupled to an electronic device through an interface port. The antenna device includes a pass-through port that may be used to couple additional devices to the interface port through the pass-through port. The interface port is illustrated as a universal serial bus (USB) port such that USB compatible devices can be coupled to the electronic device through the pass-through port. However, other interface ports may be employed without departing from the scope and spirit of the described invention. Example alternative interface ports include: serial ports, parallel ports, network communication ports such as Ethernet, Fire-wire ports such as that described in the IEEE 1394 specification, as well as others.

The electronic devices shown in the figures are for illustrative purposes only, and may be used interchangeably with any other appropriate electronic device. Example electronic devices include portable and non-portable devices such as desktop computers, notebook computers, personal data assistants (PDAs), Cellular telephones, MP3 players, pen-drives, digital video cameras, as well as other mobile and non-mobile devices. Example peripheral devices that may be coupled to the electronic device through the pass-through interface include a computer mouse, a joystick-type of controller, a keyboard, a web-camera device, a digital camera, a hard disk drive (HDD) device, a compact disk (CD) device, a digital video disk (DVD) device, a personal computer, a PDA device, a networking router, or any other device that includes a compatible interface.

The pass-through interface that is described herein may be employed to couple any two electronic devices together which include a common interface. Although the examples are described with reference to a USB interface, any other appropriate interface may also be employed without departing from the scope and spirit of the present invention.

FIG. 1A is a diagram (100) that illustrates an example antenna device that is arranged in accordance with an embodiment of the present invention. The antenna device includes an antenna housing (110) and a pass-through interface body (130). The antenna housing (110) is coupled to the pass-through interface body (130) through a connecting member(170). The antenna housing (110) includes a blocking member (120). The pass-through interface body (130) includes two ports (150, 160).

The pass-trough interface body (130) is arranged to enclose a pass-through interface device. Port 160 of the antenna device is engaged with an interface port of an electronic device (600). Although the electronic device (600) is illustrated as a personal computer, any other appropriate electronic device (e.g., PDA) is equally applicable. Moreover, although illustrated as a USB interface, the pass-through interface device and the electronic device (600) may be in electrical communication through any other appropriate interface (e.g., Firewire).

The antenna housing (110) encloses an antenna such as a loop antenna. The antenna housing is arranged to maintain the orientation of the antenna. The antenna housing is also configured to protect the antenna from impact and other sources of damage that may deform the shape of the antenna, which would result in degradation of the antenna performance.

The blocking member (120) that is illustrated in FIG. 1A is illustrated as integrated into the antenna housing. Moreover, in this example. embodiment, the antenna housing and the pass-through interface body are molded together in a single body such that the antenna housing (110) is coupled to the pass-through interface body (130) at locations 140 through the connecting members (170).

The antenna housing (110) is illustrated in a first position, where port 150 is blocked by the blocking member 120. In the first position, the antenna housing is generally in longitudinal alignment with the pass-through interface body (130) along a first axis. Blocking member 120 is longitudinally aligned along a second axis that is orthogonal to the first axis. The orthogonal alignment of the blocking member (120) provides torsional support to the antenna housing (110), which assists in maintaining the shape of the antenna within the antenna housing (110). The blocking member is also arranged in alignment with port 150 such that the port is blocked from dirt, dust, and debris when the antenna housing is in the first position.

Figure 1B:
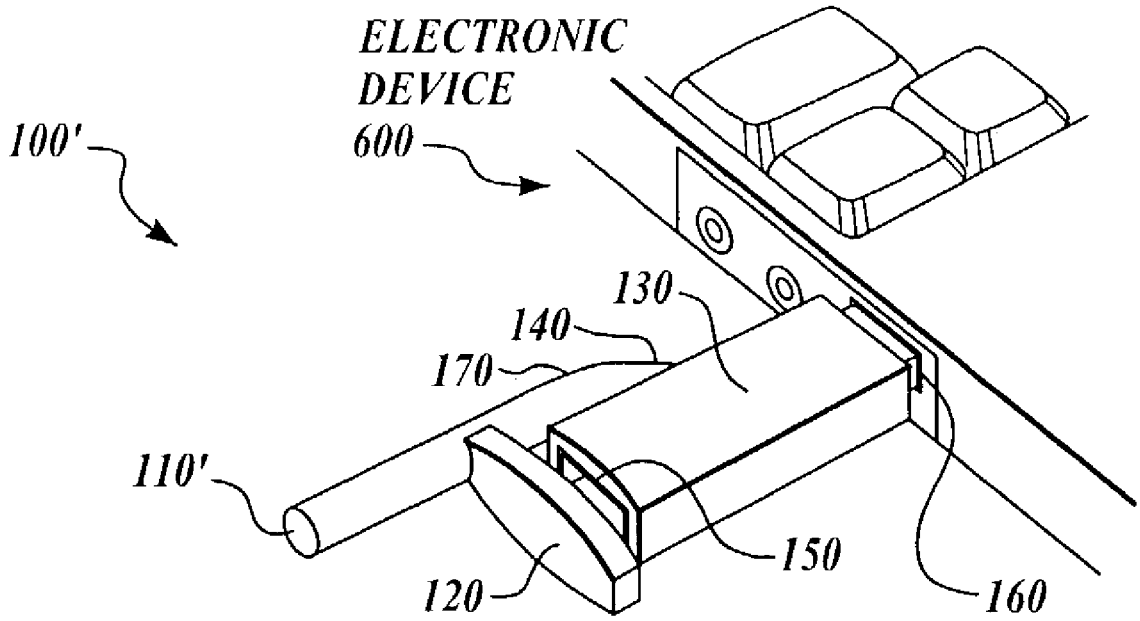
Figure 1C:
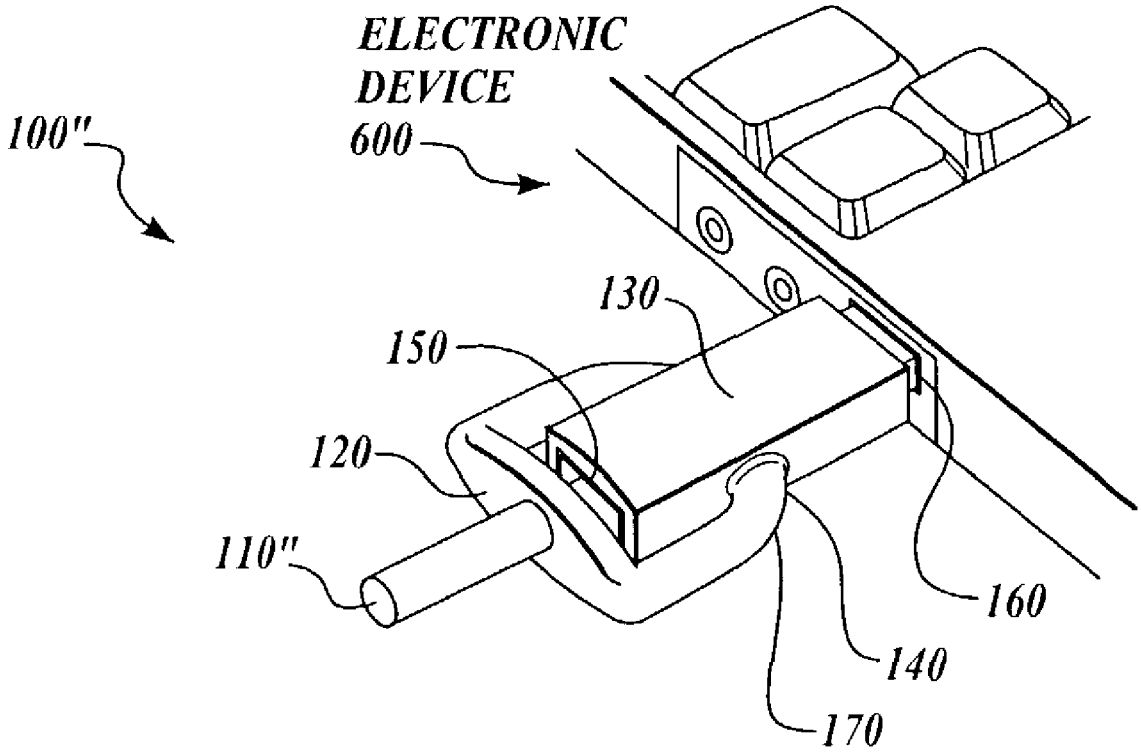

Although the antenna in the various figures is generally illustrated as a loop-type of antenna, other types of antenna structures are also contemplated as illustrated in FIGS. 1B and 1C. The antenna devices that is illustrated in FIG. 1B is substantially similar to that described with respect to FIG. 1A, and like components are labeled accordingly. However, the antenna housing (110') in FIG. 1B is arranged for use with a stick-type of antenna (e.g., a dipole antenna) instead of a loop-type of antenna. The antenna device that is illustrated in FIG. 1C is also substantially similar to that described with respect to FIG. 1B. However, the antenna housing (110") in FIG. 1C is positioned about a central area of the blocking member (120). Any appropriate antenna structure can be adapted for use in accordance with the present invention.

Figure 2:
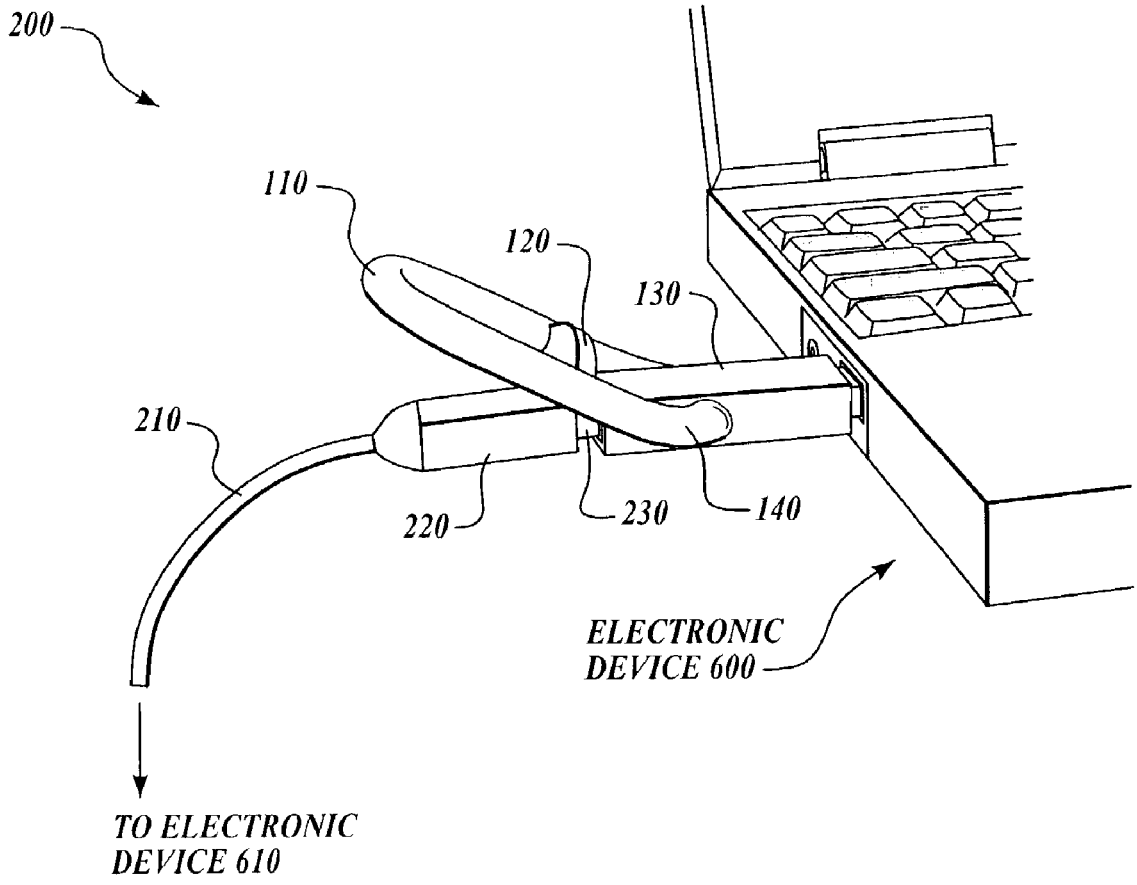
FIG. 2 is a diagram illustrating an antenna device that includes a pass-through port that is coupled to an electronic device and also engaged with a connector.

FIG. 2 is a diagram (200) that illustrates another example antenna device that is arranged in accordance with an embodiment of the present invention. The antenna device includes an antenna housing (110) and a pass-through interface body (130). The antenna housing (110) is coupled to the pass-through interface body (130) at locations 140 through the connecting members (170). The antenna housing (110) includes a blocking-member (120). The pass-through interface body (130) includes two ports as described with respect to FIG. 1.

One port (e.g., port 160) of the antenna device is shown engaged with an electronic device (600) such that the pass-through interface device is in electrical communication with the electronic device. Another port (e.g., port 150) is shown engaged with a connector 220 such that another electronic device (e.g., electronic device 610, not shown) is in electrical communication with the pass-through interface device. Electrical signals may be communicated between the other electronic device (610) and the electronic device (600) through the pass-through interface device.

In one example, the other electronic device (610) is a peripheral device such as: a computer mouse, a joystick-type of controller, a keyboard, a web-camera device, a digital camera, a hard disk drive (HDD), device, a compact disk (CD) device, a digital video disk (DVD) device, or any other device that includes a compatible interface (e.g., USB). The peripheral device (not shown) is in electrical communication with the pass-through interface device through a set of wires (210) that are coupled to a male plug (230) through a connector (220). The male plug (230) is engaged with a port (e.g., 150) in the pass-through interface device. Although illustrated as a male plug, a female plug may also be employed without departing from the scope and spirit of the invention.

In another example, the other electronic device (610) may be an extension cable such as a USB cable, or a Firewire cable. The extension cable can be used,move the antenna device such that the accessibility of the ports is improved. The extension cable can also be used to move the antenna device such that signal interference that may affect antenna performance is minimized. In still another example, the extension cable is integrally formed with the antenna device.

FIG. 2 illustrates the antenna housing (110) in a second position, where one of the ports (e.g., port 150 from FIG. 1) is cleared. The antenna housing (110) is arranged to maintain the shape of the antenna (e.g., a loop antenna, a stick antenna, etc.) such that performance of the antenna is not degraded when the antenna housing is oriented in the second position.

In the second position, antenna housing (110) is urged in a generally upward direction by the engagement of the connector (220) with the port (e.g., male plug 230). More particularly, the antenna housing (110) is urged from the first position to the second position by the interaction between the connector (220) and the blocking member (120). The second position corresponds to a rotational movement of the antenna housing (110) about the connecting members (170) at locations 140. The antenna housing (110) is biased towards the connector (220) about the connecting members (170) such that removal of the connector (220) from pass-through interface body (130) will result in urging the antenna housing (110) back to the first position.

As illustrated with respect to various figures (e.g., FIG. 2), the antenna housing is urged in a generally "upward" direction by the engagement of the connector with the port. Reference to the "upward" direction is intended to serve as an example direction for which force is applied to the antenna housing such that the position of the antenna changes. However, any other appropriate direction of movement for the antenna housing relative to the pass-through interface body is considered within the scope of the present invention. In one example, the pass-through interface body may be oriented in a vertical position such that the housing is urged in a generally horizontal direction (e.g., left or right). In another example, the pass-through interface body may be oriented in an inverted position such that the housing is urged in a generally downward direction. In still another example, the pass-through interface body may be oriented in an angular position such that the housing is urged in a generally diagonal direction. In general, the antenna housing of the present invention is urged away from pass-through interface body by the engagement of the connector with the port.

Figure 3:
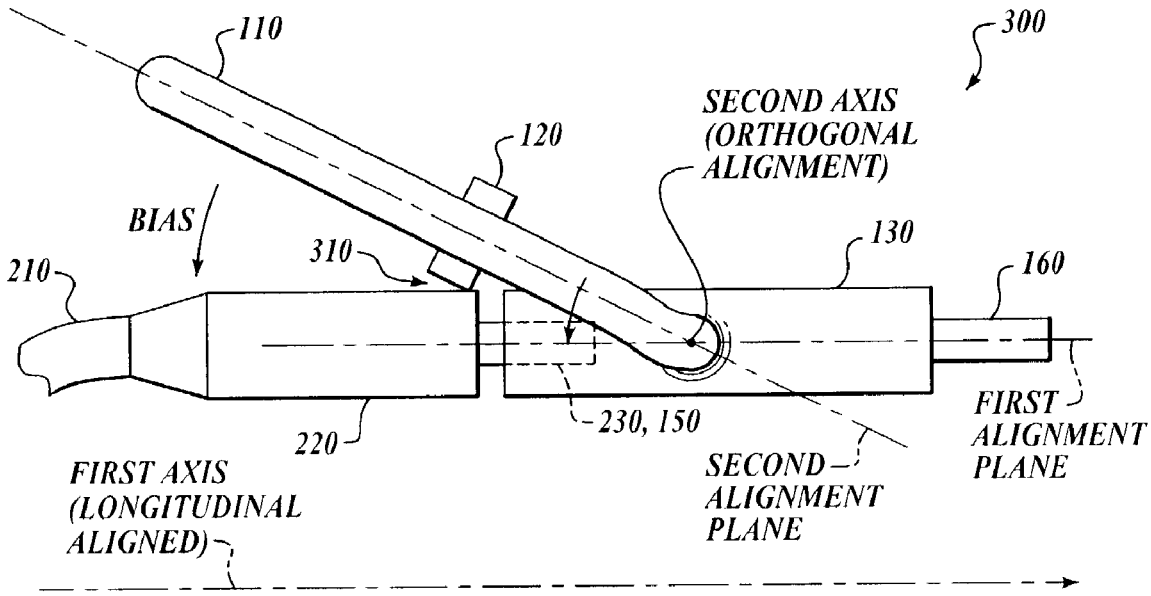
FIG. 3 is a diagram that illustrates a side view of an antenna device that includes a pass-through port that is engaged with a connector.

FIG. 3 is a diagram that illustrates a side view (300) of an antenna device that includes an antenna housing (110) and a pass-through port (130). FIG. 3 is substantially the same as that which was described in FIG. 2, where one port (150) of the pass-through interface body (130) is engaged with a male plug (230) from a connector (220).

As shown in FIG. 3, pass-through interface body 130 is in longitudinal alignment with a first axis. Blocking member 120 is maintained in longitudinal alignment with a second axis that is orthogonal to the first axis. The second axis is also a rotational axis for the antenna housing (110) with respect to the pass-through interface body (130), which extends through the connecting members (170). The antenna housing (110) is urged from a first position to a second position by the interaction between the connector (220) and the blocking member (120) at point 310.

The antenna housing is in a first alignment plane when in the first position, and a second alignment plane when in the second position. The alignment planes extend from the connecting member region of the pass-through interface body (130) along the longitudinal body of the antenna housing (130). The first alignment plane is substantially parallel to the first axis, while the second alignment plane intersects the first axis.

The antenna housing (110) is angularly biased towards the connector (220) about the second axis (the rotational axis) such that removal of the connector (220) from pass-through interface device will result in urging the antenna housing (110) back to the first position (e.g., see FIG. 1) in the first alignment plane.

Figure 4A:
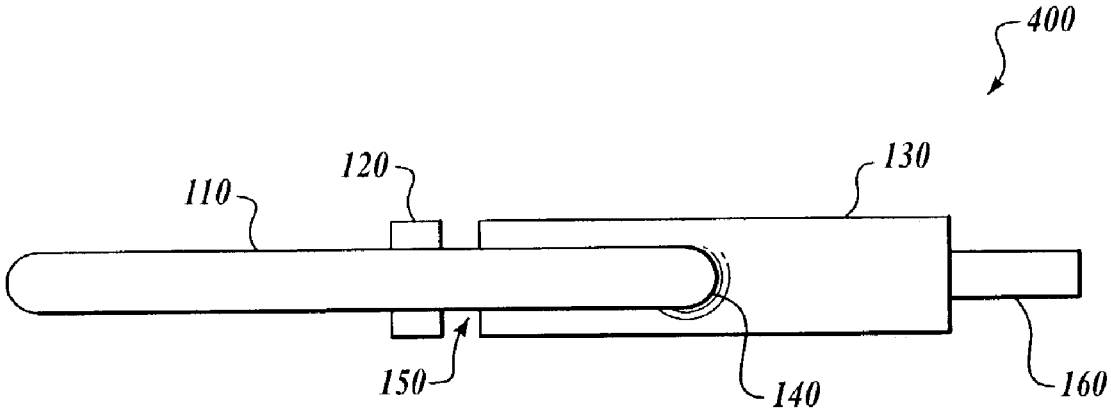
FIGS. 4A–4C are diagrams of antenna devices that include a pass-through port.
Figure 4B:
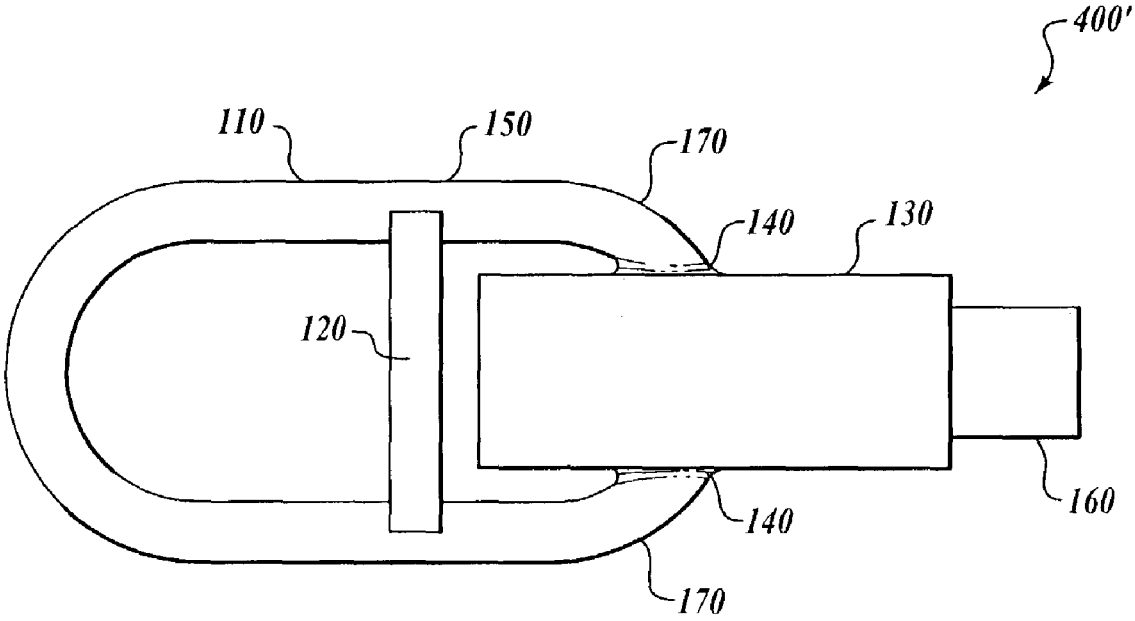
Figure 4C:
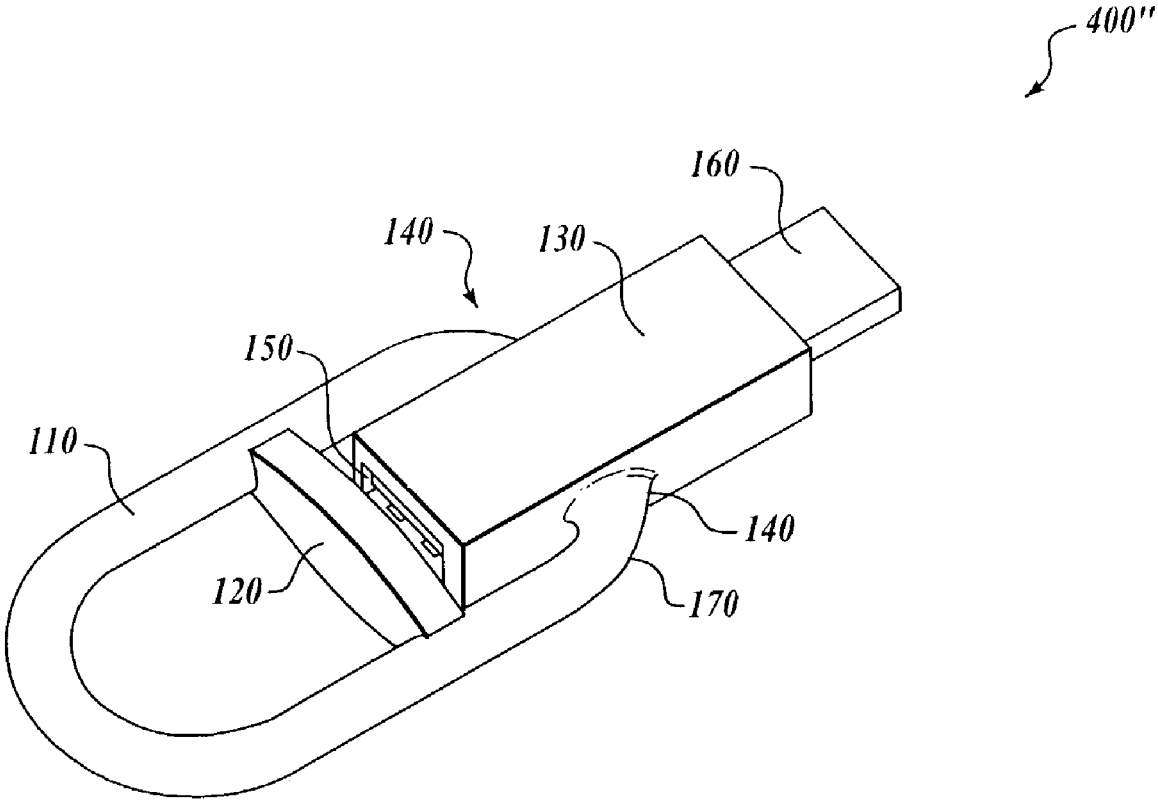

FIGS. 4A–4C are diagrams of antenna devices that include a pass-through port that is arranged in accordance with the present invention. The antenna devices illustrated in FIGS. 4A–4C may be constructed as a molded device that is encapsulated in a material. Example encapsulation materials include plastic, rubber, and an elastomer.

The connecting members (170) are arranged to flexibly couple the antenna housing (110) to the pass-through interface body (130). The connecting members are arranged to permit elastically urging the antenna housing (110) into alignment with the second alignment plane. The connecting members (170) are also arranged such that the antenna housing (110) is elastically biased into alignment with the pass-through interface body (130) in the first alignment plane. For FIGS. 4A–4C, the connecting members are each illustrated as a shoulder connection between the pass-through interface body (130) and the antenna housing (110).

FIGS. 5A–5D are diagrams of alternative antenna devices that include a pass-through port; which are arranged in accordance with the present invention.

Figure 5A:
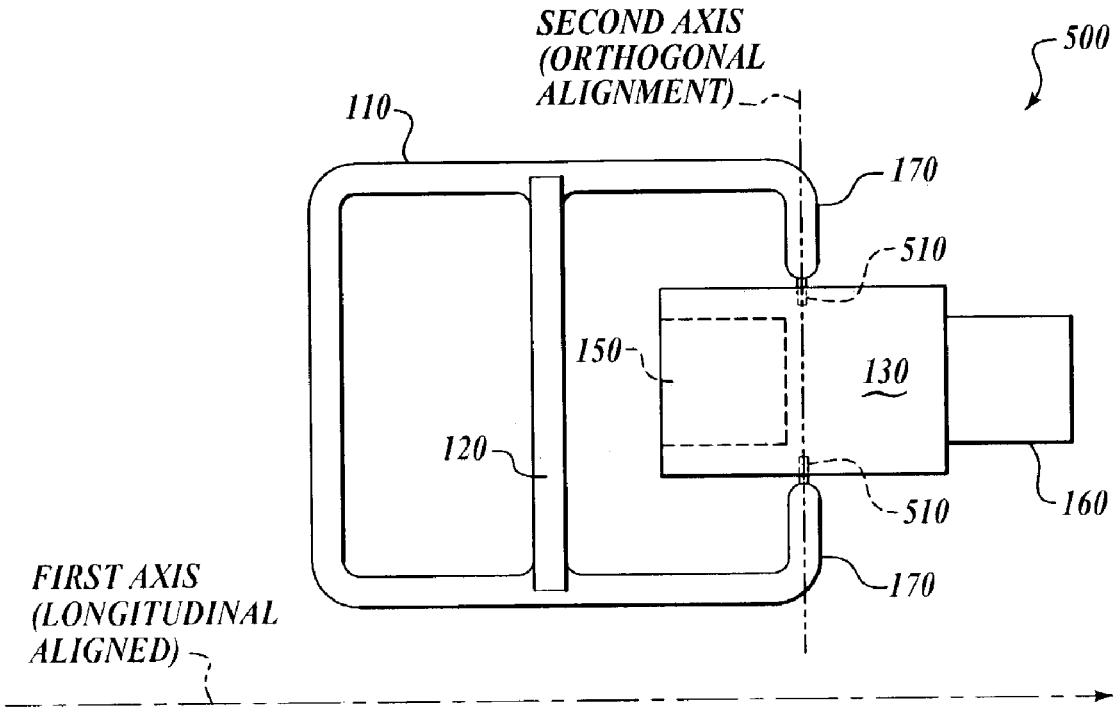
FIGS. 5A–5D are diagrams of alternative antenna devices that include a pass-through port; which are arranged in accordance with the present invention.
Figure 5B:
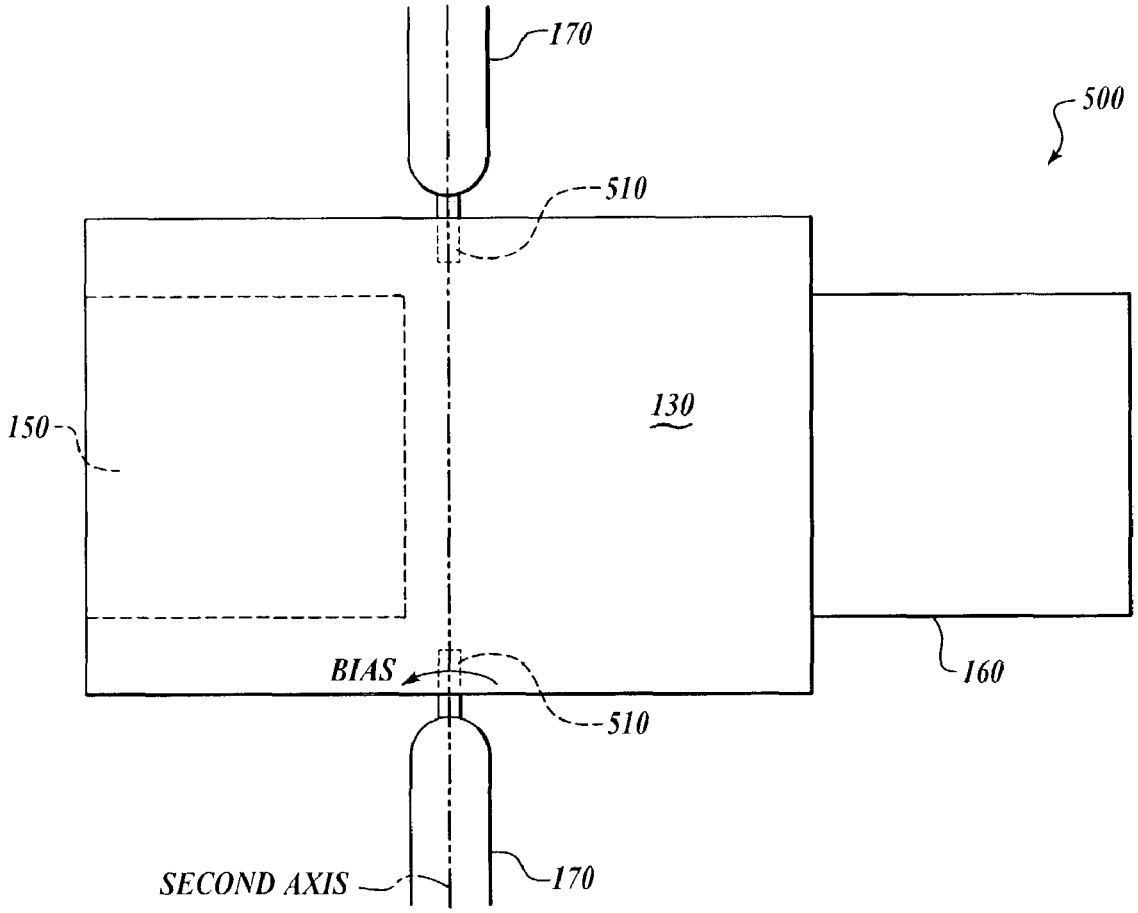

FIGS. 5A and 5B illustrate an antenna device (500) that includes substantially the same constituent parts as the antenna device illustrated in FIG. 4B. However, antenna device 500 includes a pivot joint (510) that couples the pass-through interface body (510) to the connecting members (170). The pivot joint can be formed by a set of pins, or a ball and socket arrangement that is coupled together in the pass-through interface body (130).

The pivot joints are longitudinally aligned with the second axis. As illustrated in FIG. 5B, a spring can be coupled to the connecting member such that the antenna housing (110) is biased towards the first position about the second axis. The spring can be a coil type of spring that is fixed about the shaft of one of the pivot joints, or a spring tension that is formed between a connecting member (170) and the pass-through interface body (130) such as from a flanged member.

Figure 5C:
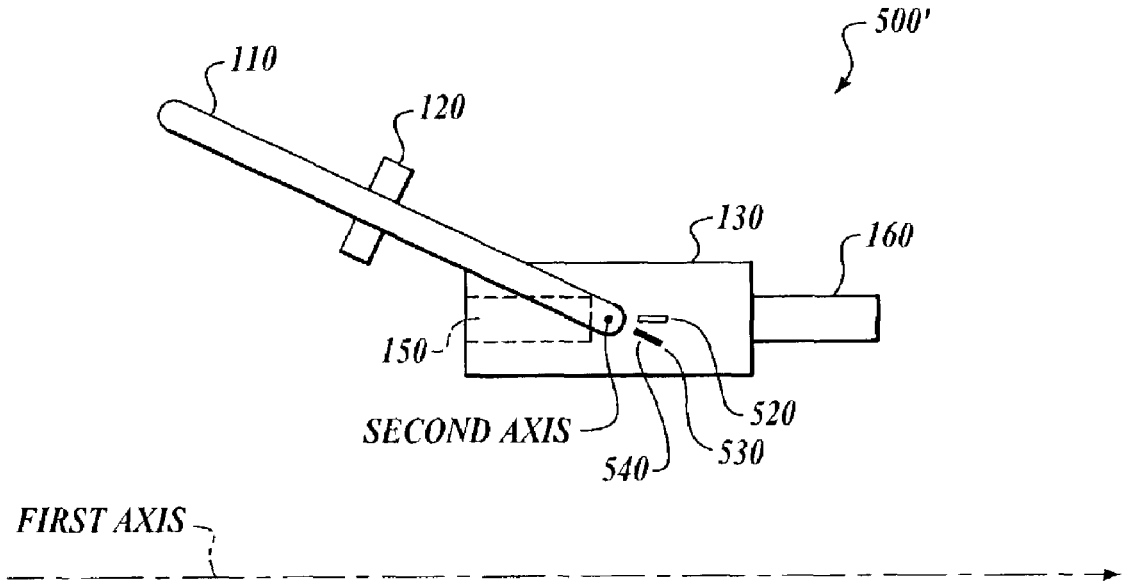
Figure 5D:
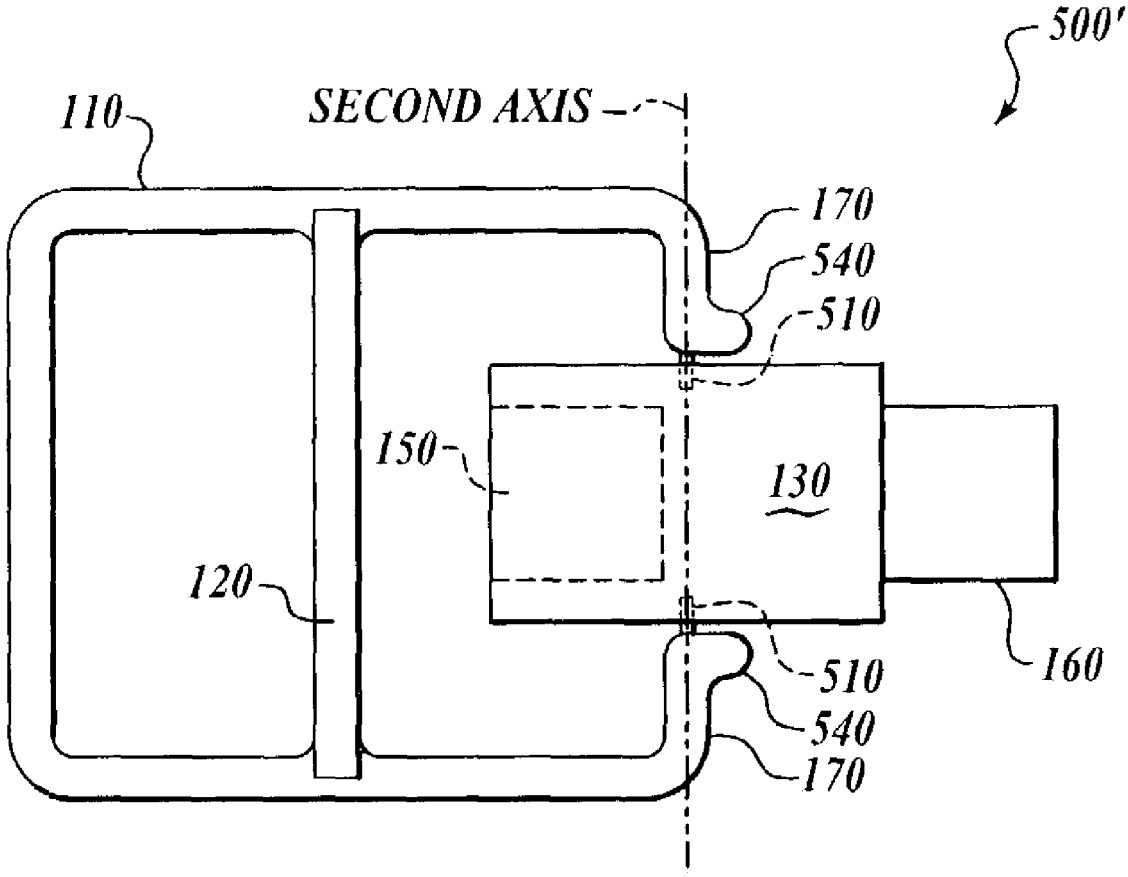

FIGS. 5C and 5D illustrate an antenna device (500') that includes substantially the same constituent parts as the antenna device illustrated in FIGS. 5A and 5B. However, antenna device 500' includes a flanged interface region (540) that is arranged to engage a portion of the connecting member (170) with the pass-through interface body (130).

In one example, the flanged portion (540) of the connecting member (170) is arranged to interact with another flanged portion (520) that is formed on the pass-through interface body (130) to provide a spring tension. The spring tension biases the antenna housing towards the first position. In another example, the flanged portion (540) of the connecting member (170) is arranged to engage a first detent (520) that is formed in the pass-through interface body (130) such that the antenna housing (110) is locked in the first position. In still another example, the flanged portion (540) of the connecting member (170) is arranged to engage a second detent (530) that is formed in the pass-through interface body (130) such that the antenna housing (110) is locked in the second position.

The above described embodiments of the invention provide a means to optimize reception performance with an antenna device that may be used as part of a receiver such as a radio frequency (RF) receiver. The antenna may be integrated into a compact device that includes a pass-through port interface. Electrical signals from the pass-through device may cause radio interference that may impede the performance of the radio receiver. Reception degradation may also be caused by the proximity of the antenna to the pass-through device or cable. The antenna is repositioned relative to the body of the pass-through interface when a device is engaged with the pass-through interface. By permitting the antenna device to be positioned in two different positions relative to the body of the pass-through interface, interference from electrical signals in the pass-through device or cable can be reduced and/or eliminated.

The combination of the antenna device and the pass-through interface permits the connection of other devices (like mouse, keyboard, or scanner), providing a compact device that accommodates the limited space that surrounds certain electronic devices such as notebook and laptop computers. If the pass-through device cable is near or touching the antenna, then the electrical signals will cause radio interference and therefore impede the performance of the radio receiver. The two positions of the antenna device relative to the pass-through interface allow the user to reposition the antenna when another electronic device is engaged in the pass-through interface.

The antenna device can be molded from a flexible rubber or elastomer. material that surrounds the entire device. The antenna housing includes a blocking member that is arranged to "block" the front of the pass-through port. When the user attaches a pass through device he/she must push the "block" away from the pass-through port and therefore automatically moves the antenna away from the pass-through device cable. The "block" also physically protects the pass-through port from dirt and dust, as well as impact damage. The antenna is returned to the flat configuration when the pass-through device is disconnected.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus that includes an antenna and a pass-through interface device, comprising:

a pass-through interface body that is configured to enclose the pass-through interface device, wherein the pass-through interface device includes a first port and a second port, wherein the first port is in electrical communication with the second port;

an antenna housing that is configured to enclose the antenna;

connecting members that are arranged to couple the antenna housing to the pass-through interface body; and a blocking member, wherein the blocking member is arranged to block the first port in the pass-through interface device when the antenna housing is in a first position, and wherein the blocking member is clear from the first port when the antenna housing is in a second position.

2. The apparatus of claim 1, wherein the antenna housing is arranged in longitudinal alignment with the pass-through interface body when the antenna housing is in the first position.

3. The apparatus of claim 1, wherein the antenna housing is arranged in longitudinal alignment with the pass-through interface body when the antenna housing is in the first position such that the antenna housing is oriented in a first plane, and wherein the antenna housing is oriented in a second plane that intersects with the first plane when the antenna housing is in the second position.

4. The apparatus of claim 1, wherein the connecting members are arranged in cooperation with the pass-through interface body such that the antenna housing is biased towards the first position.

5. The apparatus of claim 1, wherein the blocking member is arranged to substantially maintain the shape of the antenna within the antenna housing.

6. The apparatus of claim 1, wherein the connecting members, the pass-through interface body, and the antenna housing are integrally formed from at least one of: rubber, plastic, and an elastomer.

7. The apparatus of claim 1, wherein the antenna housing and the blocking member are integrally formed from at least one of: rubber, plastic, and an elastomer.

8. The apparatus of claim 1, wherein the antenna housing and the connecting members are integrally formed from at least one of; rubber, plastic, and an elastomer.

9. The apparatus of claim 1, wherein the connecting members and the pass-through interface body are integrally formed from at least one of: rubber, plastic, and an elastomer.

10. The apparatus of claim 1, wherein the connecting members are arranged as shoulders between the pass-through interface body and the antenna housing.

11. The apparatus of claim 1, wherein the connecting members are coupled to the pass-through interface body through pivot joints.

12. The apparatus of claim 11, wherein each pivot joint is arranged as at least one of: a pin device, and a ball and socket arrangement.

13. The apparatus of claim 11, wherein at least one pivot joint includes a spring tension device that is arranged to bias the antenna housing from the second position to the first position.

14. The apparatus of claim 11, wherein at least the connecting member includes a flange region that is arranged for engagement with the pass-through interface body such that the antenna housing is biased from the second position to the first position.

15. The apparatus of claim 11, wherein at least the connecting member includes a flange region, and wherein the pass-through interface body includes a first locking member that is arranged to engage the flange region such that the antenna housing is locked in the first position.

16. The apparatus of claim 11, wherein at least the connecting member includes a flange region, and wherein the pass-through interface body includes a second locking member that is arranged to engage the flange region such that the antenna housing is locked in the second position.

17. The apparatus of claim 1, wherein the antenna housing is urged from the first position to the second position by user interaction, and wherein the antenna housing is maintained in the second position by contact between the blocking member and a connector when the connector is engaged with the pass-through interface device.

18. The apparatus of claim 17, wherein the antenna housing automatically returns from the second position to the first position when the connector is disengaged from the pass-through interface device.

19. An apparatus that includes an antenna and a pass-through interface device, comprising:

a first means for enclosing that is arranged to enclose the pass-through interface device, wherein the pass-through interface device includes a first port and a second port, wherein the first port is in electrical communication with the second port;

a second means for enclosing that is arranged to enclose the antenna;

a means for coupling that is arranged to couple the first means for enclosing to the second means for enclosing;

a means for blocking that is arranged to block the first port when the first port is disengaged from operation; and a means for orienting that is arranged to maintain the orientation of the antenna away from the first port when the first port is engaged in operation.

20. A method for automatic orientation of an antenna and a pass-through interface device, the method comprising:

providing a pass-through interface device including a first port and a second port, wherein the first port is in electrical communication with the second port;

enclosing the antenna in an antenna housing;

enclosing the pass-trough interface device in a pass-through interface body;

coupling the antenna housing to the pass-through interface body;

blocking the first port when the antenna housing is longitudinally aligned with the pass-through interface body in a first position;

urging the antenna housing from the first position to a second position such that the first port is accessible;

maintaining the antenna housing in the second position when the first port is engaged in operation; and returning the antenna housing from the second position to the first position when the first port is disengaged from operation.

21. An apparatus that includes an antenna and a pass-through interface device, comprising:

a pass-through interface body that is configured to enclose the pass-trough interface device, wherein the pass-trough interface device includes a first port and a second port, wherein the first port is in electrical communication with the second port;

an antenna housing that is configured to enclose the antenna;

connecting members that are arranged to couple the antenna housing to the pass-through interface body, wherein the connecting members are arranged in cooperation with the pass-through interface body such that the antenna housing is biased towards the first position; and a blocking member, wherein the blocking member is arranged to block the first port in the pass-through interface device when the antenna housing is in a first position, and wherein the blocking member is clear from the first port when the antenna housing is in a second position.

22. The apparatus of claim 21, further comprising: an urging device, wherein the urging device is coupled to the pass-through interface body and the blocking member, and wherein the urging device is arranged to urge the blocking member into alignment with the first port of the pass-through interface body.

23. The apparatus of claim 22, wherein the urging device is integrally formed with at least the antenna housing, the connecting member, the pass-through interface body, and the blocking member.

24. An apparatus that includes an antenna and a pass-through interface device, comprising:

a first means for enclosing that is arranged to enclose the pass-through interface device, wherein the pass-through interface device includes a first port and a second port, wherein the first port is in electrical communication with the second port;

a second means for enclosing that is arranged to enclose the antenna;

a coupling means that is arranged to couple the first means for enclosing to the second means for enclosing;

a means for blocking that is arranged to block the first port when the first port is disengaged from operation;

a biasing means that is arranged to bias the means for blocking in alignment with the first port; and a means for orienting that is arranged to maintain the orientation of the antenna away from the first port when the first port is engaged in operation.

25. The apparatus of claim 24, wherein the biasing means is integrally formed with at least: the first means for enclosing, the second means for enclosing, the coupling means, the means for blocking, and the means for orienting.

26. An apparatus that includes an antenna and a pass-through interface device, wherein the pass-through interface device permits electrical communication between a primary electronic device and a second electronic device, the apparatus comprising:

a pass-through interface body that is configured to enclose the pass-through interface device;

an antenna housing that is coupled to the pass-through interface body, wherein the antenna housing is configured to enclose the antenna;

a first port in the pass-through interface body, wherein the first port is arranged for operative engagement with the primary electronic device;

a second port in the pass-through interface body, wherein the first port is in operative communication with the second port, and wherein the second port is arranged for operative engagement with the secondary electronic device; and a blocking member that is coupled to at least one of the pass-through interface body and the antenna housing, wherein the blocking member is arranged to cover the second port when the secondary electronic device is disengaged from the second port.

* * * * *